US005380365A

United States Patent [19]

Hirshburg

[11] Patent Number: 5,380,365

[45] Date of Patent: Jan. 10, 1995

[54] LIP SURFACE GEOMETRY FOR SLIDE BEAD COATING

[75] Inventor: Robert I. Hirshburg, Hendersonville, N.C.

[73] Assignee: E. I. Du Pont de Nemours and Company, Wilmington, Del.

[21] Appl. No.: 823,695

[22] Filed: Jan. 21, 1992

[51] Int. Cl.[6] ..... B05C 3/12

[52] U.S. Cl. ..... 118/410; 118/411; 118/325; 118/DIG. 2

[58] Field of Search ..... 118/410, 411, 412, DIG. 2, 118/419, 325; 427/434.2, 402

[56] References Cited

U.S. PATENT DOCUMENTS

| | | | |
|---|---|---|---|
| 3,220,877 | 11/1965 | Johnson | 117/120 |
| 3,928,678 | 12/1975 | Jackson | 427/402 |
| 4,440,811 | 4/1984 | Hitaka et al. | 427/402 |
| 4,443,504 | 4/1984 | Burket et al. | 427/445 |
| 4,490,418 | 12/1984 | Yoshida | 427/445 |
| 4,808,444 | 2/1989 | Yamazaki et al. | 427/420 |

FOREIGN PATENT DOCUMENTS

| | | | |
|---|---|---|---|
| 0300098 | 7/1987 | European Pat. Off. . | |
| 0157629 | 6/1989 | Japan . | |
| 858118 | 1/1961 | United Kingdom | 118/DIG. 2 |

OTHER PUBLICATIONS

Patent Abstract of Japan, vol. 011246, 11 Aug. 1987, JP62053768.

Patent Abstract of Japan, vol. 011232, Jul. 1987, JP62045377.

*Primary Examiner*—W. Gary Jones
*Assistant Examiner*—Brenda Lamb

[57] ABSTRACT

A slide bead coating apparatus including a break and associated offset in the coating lip surface. Slide bead coating is employed in the manufacture of single- and multi-layered elements such as photographic film.

3 Claims, 4 Drawing Sheets

LIP SURFACE GEOMETRY FOR SLIDE BEAD COATING

FIELD OF THE INVENTION

This invention relates to a slide bead coating apparatus. More specifically, this invention relates to a slide bead coating apparatus for coating one or more liquid layers onto a moving substrate.

BACKGROUND OF THE INVENTION

Slide-bead coating is a process well known in the art. It entails flowing a liquid layer or layers down an inclined slide surface to an efflux end, or lip, positioned a short distance from a moving substrate. The liquid forms a bridge, or bead, in the gap between the lip and the moving substrate. The moving substrate carries away liquid from the liquid inventory in the bead in the same layered structure established on the slide. See, for example, Russell, et al., U.S. Pat. Nos. 2,761,791 and 2,761,419.

Customarily, the slide bead coating process is initiated through a sequence of steps. As depicted in FIG. 1, the flow of the coating solutions, 1 and 2, is established with the coating roll, 7, and coating head assembly, represented as 3 and 4, (and any associated attachments) far enough apart to allow the coating solution to flow as a moving film of liquid over the face of the coating plate 3 and into vacuum chamber, 14. It is drained from chamber 14 through tube 16 to sump 17. The coating head assembly, 3 and 4, and coating roll, 7, are then moved close enough to establish flow across the gap, 5, between the coating head and the substrate, 6, as depicted in FIG. 2.

At the instant of coating initiation and for a time thereafter, a residual liquid film, 20, covers the coater face, 21, from the base of the newly formed bead, 18, down into the vacuum chamber, 14, as illustrated in FIG. 3. In the vicinity of the bead, 18, strong bulk viscous and interfacial extensional forces tend to pull liquid up from the residual film, 20, into the bead, 18, and thereby onto the substrate surface, 6. Further down the coater face, 21, the liquid film continues to flow toward and into the chamber, 14, thinning the residual film, 20. This thinning occurs most rapidly in the vicinity of the bead, 18. Eventually, the liquid film at the thinnest point either ruptures or dries depending on whether or not the liquid wets the coater face, 21. In either case a stationary wetting line, or static contact line, 22, is formed as shown in FIG. 4.

In the time following coating initiation and before static contact line formation, the liquid from the residual film that is pulled up into the bead, 18, may contain particles or agglomerates from deposits originally located below the bead on the coater face, 21. These particles and agglomerates subsequently interact with the flow in the bead, either directly interfering with the bead internal flow pattern or indirectly interfering with the uniformity of the coating flow envelope by contacting the lower bead meniscus. Defects in the film such as a variation in the coated thickness across the substrate, are generated by these types of interference. Such coating defects, often called streaks by those practicing the coating art, may render the resulting material unusable for the intended application. In other cases, the transient liquid film flowing into the base of the meniscus may be irregular and can consequently cause nonuniformities in the coating during the liquid film transient.

The transient liquid film flow in which the coating is either immediately or subsequently vulnerable to streaks may last as long as ten seconds depending on the liquid viscosity, substrate speed, coating and pre-coating flow rates and coater face geometry. If the coater face, 21, diverges from the substrate by approximately 15 degrees or more, the transient duration will be long, typically greater than 5 seconds. If the coater face, 21, is approximately parallel with the substrate surface, 6, the transient will be terminated very quickly, typically in less than about one second. Unfortunately, such quick termination also leads to streak defects because the liquid film, 20, dries or ruptures thus forming an irregular static contact line prior to the bead lower meniscus terminus reaching its equilibrium position for steady-state operation.

Various technologies have been proposed to avoid the occurrence of the streak defects. The technology disclosed by Hitaka and Takemasa, U.S. Pat. No. 4,440,811, modifies the coater lip region to include a notch whereby the bead contact line is preferentially located along the notch tip. However, the proposed configuration is expensive to fabricate to the precision required, and in practice the notch promotes deposits and settling from the flowing material and is difficult to clean.

Japanese Patent Publication No. 48-4371 discloses use of a land inclined with respect to the substrate tangent so as to locate the wetting line at the sharp coating lip. This configuration allows the sharp lip region to be excessively vulnerable to mechanical damage in the form of a crack or scratch that would, in-turn, result in streaks. To avoid this problem Jackson, in U.S. Pat. No. 3,928,678, discloses the technology of rounding or bevelling the tip edge of the lip to increase the mechanical robustness of the lip tip. The configuration additionally positions the bead static contact line away from the lip. However, no dimensions or orientations are disclosed whereby the bead static contact line can be preferentially and advantageously positioned at the lower edge of the bevel. As stated by Hitaka et al in U.S. Pat. No. 4,440,811 in reference to using such a bevel: ". . . it was difficult to hold the end of the beads at a fixed place or to restore the said end to the original state."

A more successful approach is disclosed in commonly assigned copending patent application Ser. No. 07/823,696 (filed concurrently herewith under Assignee's Case No. IM-0430). In that case, the lip region is configured with a short upper lip land that intersects a lower lip surface at an angle large enough to preferentially locate the wetting line at the line of intersection. Although this technology successfully avoids static contact line irregularities and subsequent streaks, it is still vulnerable to occasional streaks caused by particles occasionally washing into the intersection line region from residual film flow during start-up.

SUMMARY OF INVENTION

The invention comprises an improved slide bead coating apparatus and process having a liquid film transient of moderate duration, and fewer defects in the resultant film. In a primary aspect, the invention is directed to a slide bead coating apparatus comprising:

a bead region wherein a flowing liquid layer or layers is continuously applied to a moving substrate;

a roller, and associated drive means, for conveying said substrate longitudinally through said bead region;

a means for continuously supplying said flowing liquid layer or layers to a slide surface of a coating head;

a coating lip tip at the terminus of said slide surface of said coating head and within said bead region; and a lip surface extending from the coating lip tip down into the bead region opposite the moving substrate;

wherein the coating apparatus further comprises:

a break and associated offset in the lip surface, the break being located 0.5–5.0 mm below said coating lip tip and forming an angle with said lip surface of at least 15° in a direction away from said substrate, and the offset having an average depth at least 0.25 mm from the plane of the lip surface and being at least 0.5 mm long.

In another aspect, the invention is directed to a slide bead coating apparatus having a bead region wherein a flowing liquid layer or plurality of flowing liquid layers is continuously applied to a moving substrate, said coating apparatus comprising:

a bead region wherein a flowing liquid layer or layers is continuously applied to a moving substrate;

a roller, and associated drive means, for conveying said substrate longitudinally through said bead region;

a means for continuously supplying said flowing liquid layer or layers to a slide surface of a coating head;

a coating lip tip at the terminus of said slide surface of said coating head and within said bead region; and a lip surface extending from the coating lip tip down into the bead region opposite the moving substrate;

wherein the coating apparatus further comprises:

a low energy surface 0.05–5.00 mm below said coating lip tip on said lip surface.

In a further aspect, the invention is directed to a method for forming a photographic element wherein said photographic element comprises a substrate and at least one hydrophilic colloid layer at least one of which is a photosensitive layer; said method comprising the steps of:

supplying layer or layers of said hydrophilic colloid to the slide surface of a coating head of the slide bead coating apparatus described above;

flowing said layer or layers into the gap between said substrate and the coating lip tip at the terminus of said slide surface thereby forming a bead region;

longitudinally conveying said substrate through said bead region wherein said hydrophilic colloid is continuously removed from said bead region in the form of a liquid film coating on said substrate; and removing volatile components of said liquid film coating on said substrate thereby forming a substantially rigid hydrophilic colloid coating on said substrate.

DETAILED DESCRIPTION OF INVENTION

Throughout the following detailed description, similar referenced characters refer to similar elements in all drawings.

Figure 1:
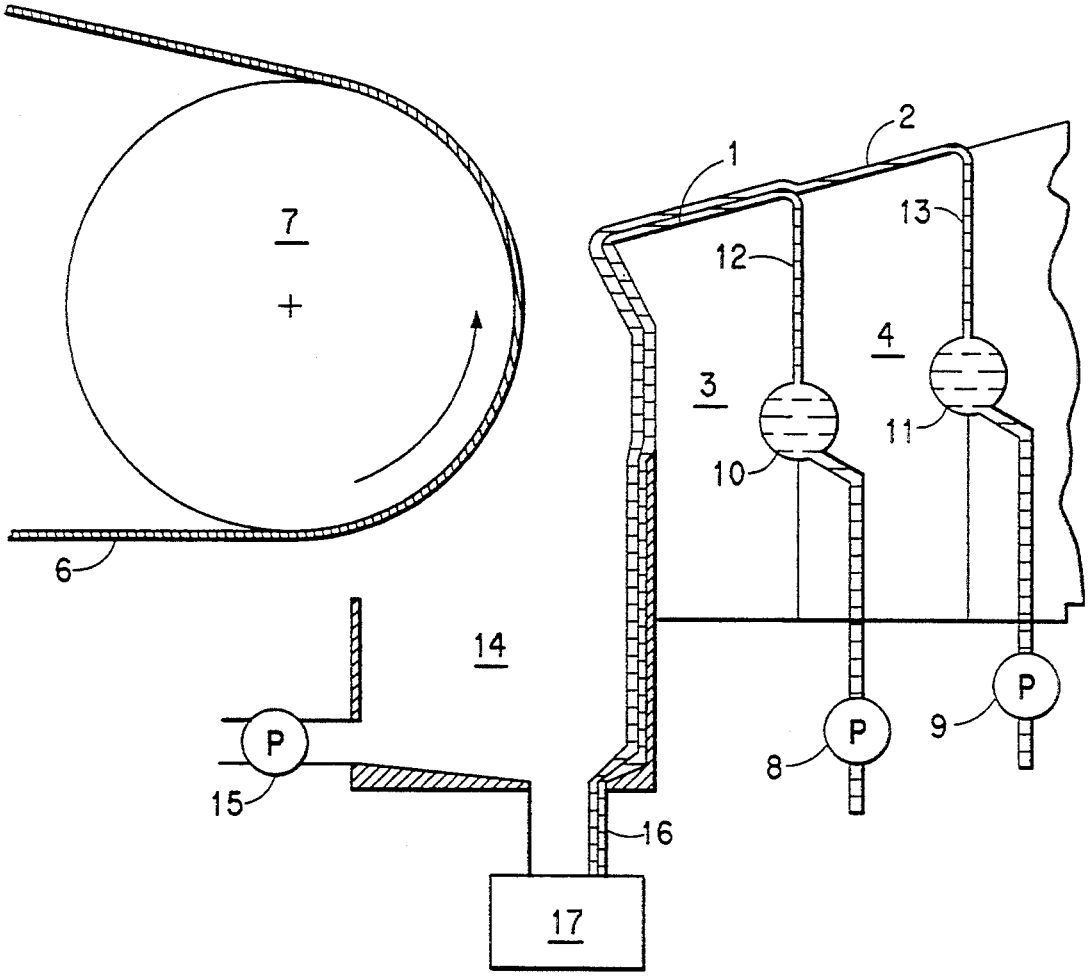
FIG. 1 (PRIOR ART)
FIG. 1 is a schematic representation of a conventional slide bead coating apparatus immediately prior to the start of coating.
Figure 2:
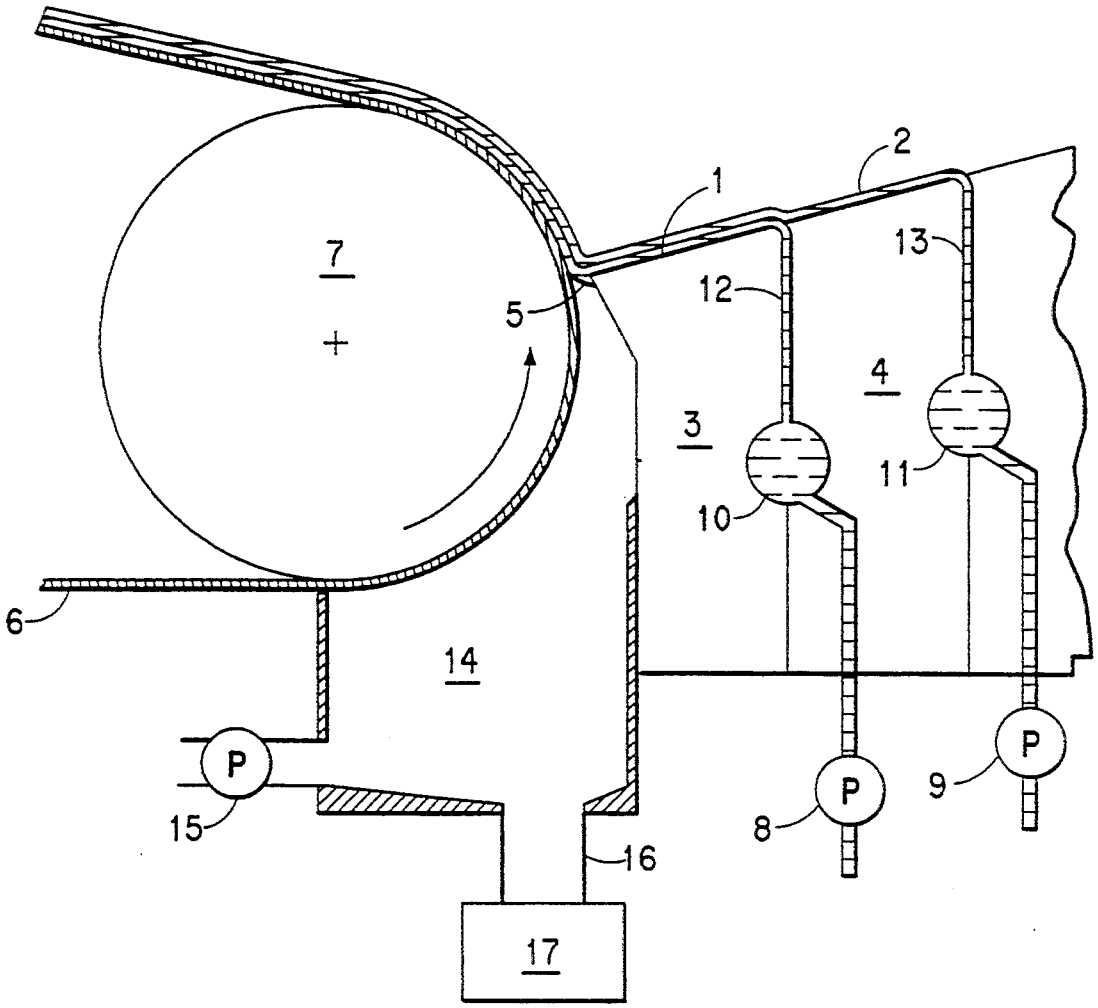
FIG.2 (PRIOR ART)
FIG. 2 is a schematic representation of a conventional slide bead coating apparatus immediately after coating has begun.

A side view of a conventional slide bead coating apparatus prepared for the start of the coating operation is displayed in FIG. 1. The same apparatus is displayed during the coating operation in FIG. 2. The apparatus will be described in detail with reference to FIG. 2. The liquids to be coated, 1 and 2, are supplied to plates 3 and 4. Coating additional layers would require additional plates which can readily be included but are not illustrated here. The liquids 1 and 2 flow down the inclined slide surface and traverse a gap, 5, between the closest plate, 3, and the substrate 6 thereby forming a coated layer on the substrate. The substrate 6 is conveyed by a roller 7. Coating liquid is supplied by an appropriate number of supply pumps 8, 9 which feed into cavities 10, 11 and slots 12, 13. An appropriate number of pumps, cavities and slots are required to coat more layers than depicted in the figure. A chamber 14, and associated pump 15, is adapted to reduce the gas pressure on the lower surface of the liquid in the gap 5. A drain tube, 16, and sump, 17, remove material from chamber 14.

Figure 3:
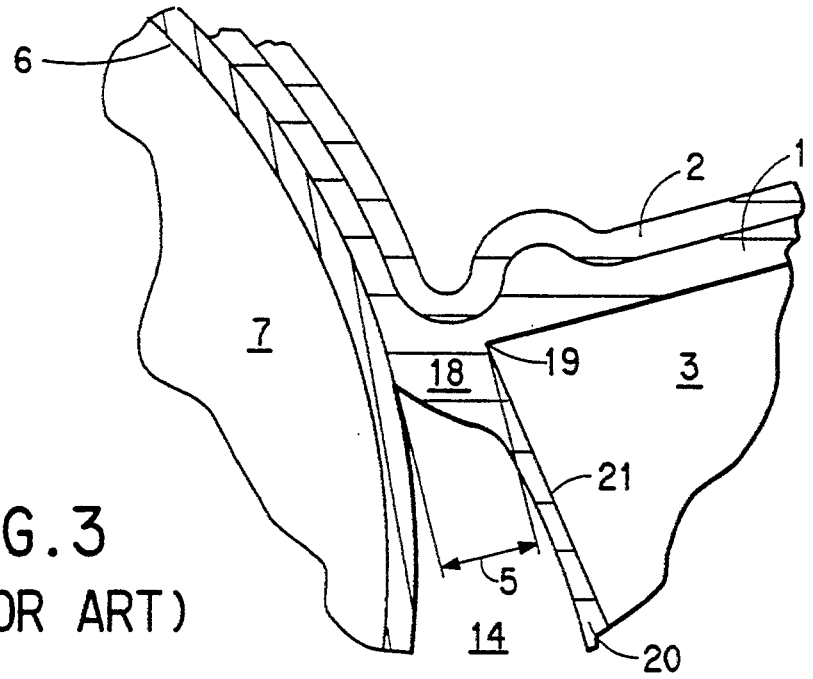
FIG.3 (PRIOR ART)
FIG. 3 is a schematic representation of the coating bead region of a conventional slide bead coating apparatus during the liquid film transient period after coating has begun, before establishment of a steady state.
Figure 4:
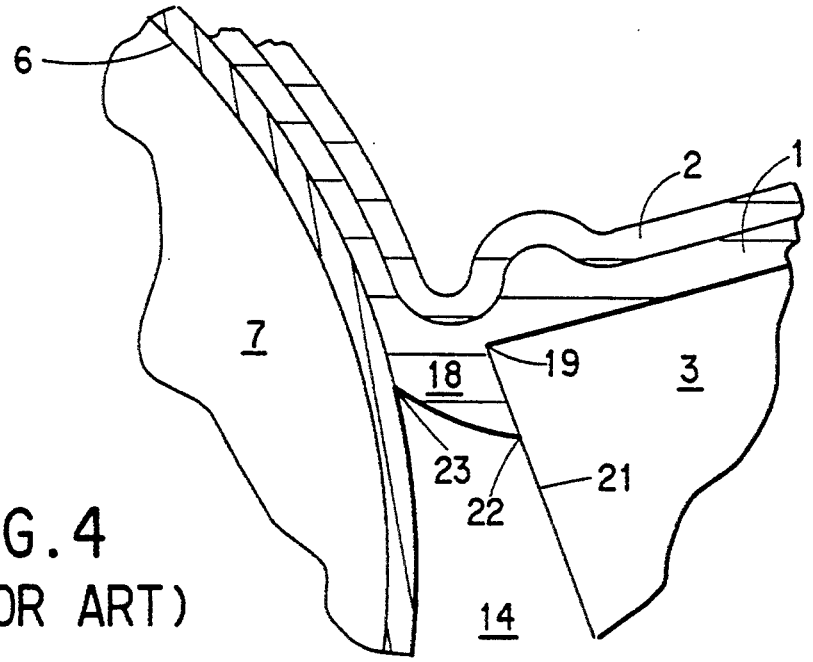
FIG.4 (PRIOR ART)
FIG. 4 is a schematic representation of the coating bead region of a conventional slide bead coating apparatus during steady state operation.

Focusing on the gap, or bead, region depicted in FIG. 3, coating liquids 1, 2 flow down the slide surface and over the coater lip tip 19, to form a continuous liquid bridge, or bead, 18, between the lip tip, 19, and the substrate 6. The closest distance between the lip tip and the substrate surface, referred to as the coating gap 5, is typically 0.1 to 0.5 mm. The differential pressure between the gas above the top liquid surface, usually at atmospheric pressure, and the gas below the bottom liquid surface as applied by chamber 14 and associated pump 15 (not shown) draws the liquid bead into the gap between the coater face, 21, and the substrate, 6. Typical pressure differentials of 400 to 4000 dynes/cm$^2$ are applied. As illustrated in FIG. 4, the applied differential pressure produces a stable bead with a spatially-stationary liquid wetting line, or static contact line 22, on the coater face, 21, and a spatially-stationary liquid wetting line, or dynamic contact line, 23, on the moving substrate. Typical substrate speeds are 25 to 300 cm/sec.

Figure 5:
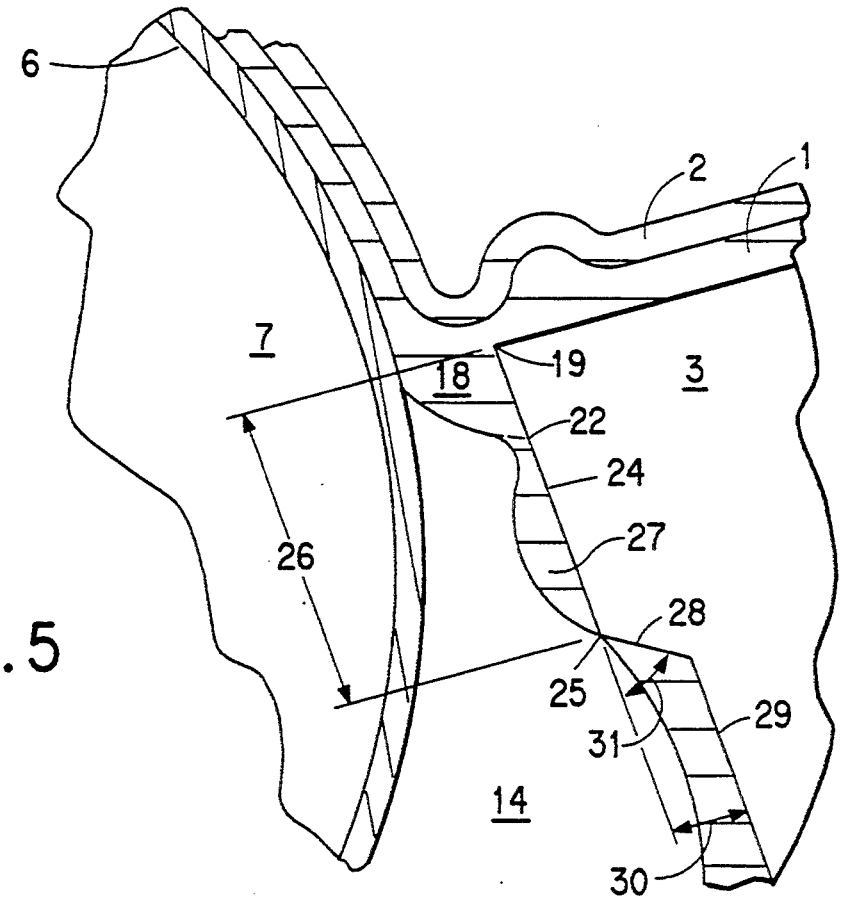
FIG. 5 is a schematic representation of a coating bead region of the present invention just after establishment of a coating bead.

FIG. 5 shows an embodiment of the present invention. In this invention, the coater geometry in the lip region is configured with a lip surface, 24, opposite the substrate surface, 6. The lip tip 19 is the uppermost part of surface 24. The shortest distance between surface 24 and substrate 6 is at the lip tip 19. Below lip tip 19, surface 24 angles down and away from the tangent to the substrate 6 at the location of the coating by at least 10°. A corner, or break, 25, in lip surface 24 is positioned a distance, 26, below the lip tip, 19. The break, 25, is an abrupt change in the lip surface orientation in a direction away from the substrate. Following the break is offset 30. Second surface, 28, and possibly additional surfaces such as 29 create offset 30 relative to the plane of the lip surface, 24. The break and associated offset limit the extent of liquid film, 27, available for being drawn up through extensional forces into the bead, 18 by isolating from the bead the reservoir of liquid in the film below the break, 25.

The distance, 26, from the lip tip, 19, to the break, 25, is preferentially 0.5 mm to 5.0 mm within which transient time can be beneficially controlled. Most preferably, the distance, 26, is 2.0 mm to 3.5 mm which results in preferred liquid film transient durations of about 1 to 3 seconds, in most cases. A transient time of 1 to 3 seconds is of sufficient duration to establish a uniform static contact line at the equilibrium position. Longer transient times allow more particles and agglomerates to wash into the bead region. If the break, 25, is positioned at a distance of less than about 0.5 mm below the lip tip, 19, the break will not be sufficiently removed from the static contact line, 22, to separate the liquid below the break from communication via extensional forces with the bead thus circumventing the benefit of the break and resulting in a transient time that is too long. Positioning the break at greater than 5.0 mm from the lip tip imparts no benefit to terminating the liquid film transient at the break, 25: the break is positioned beyond the region of extensional flow influence and the liquid film transient duration approaches that of the conventional lip configuration with the same divergent lip surface-to-substrate angle.

The change in lip surface direction, 31, at the break must be at least 15°, is more preferably greater than 25° and maybe as large as practical considerations such as proper surface drainage allow. The break is depicted in FIG. 5 as being the intersection of two planar surfaces at a line but beneficial results can also be attained with a small corner element such as with a small convex cylindrical sector, a corner of multiple small facets or a small chamfer.

The average depth of the offset, 30, must be about 0.25 mm and is more preferably 0.35 mm or more to effectively separate the lower liquid film from the influence of the bead. The length of the offset must be at least about 0.5 mm in order to be effective and is more preferably 1.0 mm or more but the required extent will be longer for breaks at shallower angles. The extent of the offset below the break, 25, can be quite large as through extension of the offset surface or limited in extent as accomplished with a groove or cylindrical concave surface. The break, 25, and subsequent offset, 30, can be realized via flat surfaces as shown in FIG. 5 or by curved surface(s).

Figure 6:
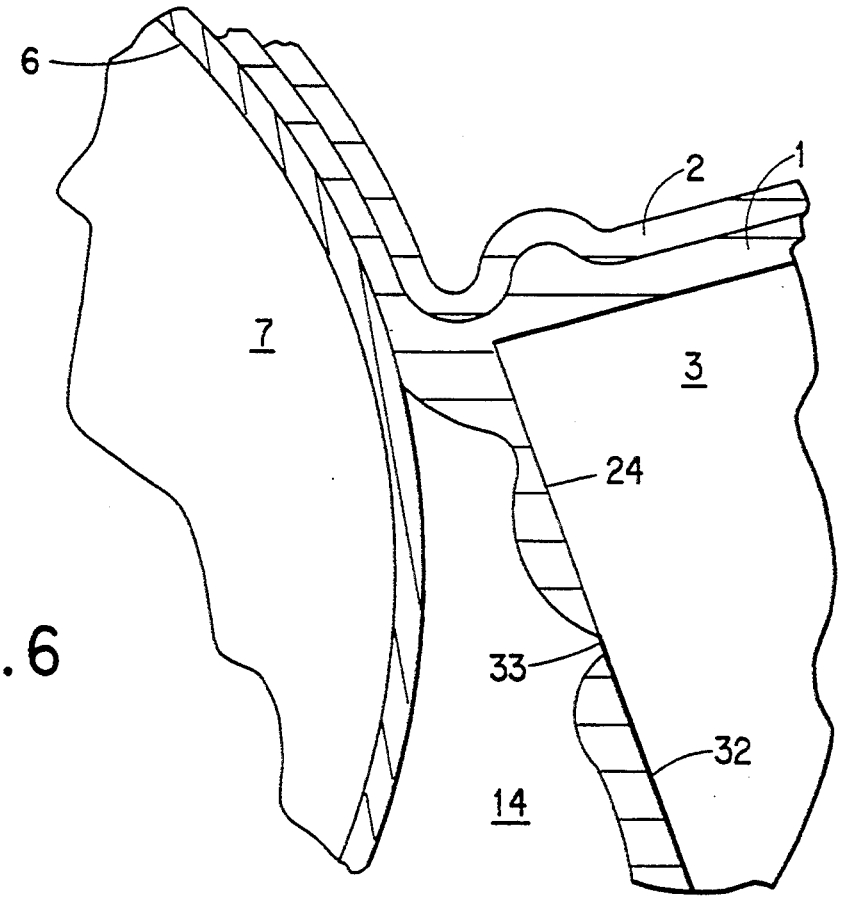
FIG. 6 is a schematic representation of a coating bead region of the present invention just after establishment of a coating bead.

A surface comprising a composition that exhibits low energy relative to that of the coating solution, and which has its starting edge located at a distance of 0.5 to 5.0 mm below the lip tip can also be beneficial in controlling the duration of transient liquid and is accordingly included in the invention. The coating solution will not freely wet or spread on such a low energy surface. Examples include, but are not limited to, substituted polymers of ethelene and particularly preferrable are flourinated polyethylenes such as polyfluoroethylene. As shown in FIG. 6, this low-energy surface, 32, can be roughly co-planar with the lip surface, 24, and can cause early rupture of the liquid film via thin-film instability at the leading edge, 33, of the low-energy surface, 32. Alternatively, low-energy surfaces can be used as the surfaces of the geometric offset described above with the additional advantages of ease of cleaning and efficient draining.

The invention described herein is useful for a myriad of flowing liquids including, but not limited to, those with photosensitive and or radiation sensitive layers. These photosensitive and/or radiation sensitive layers may be any which are well-known for imaging and reproduction in fields such as graphic arts, printing, medical, and information systems. Silver halide photosensitive layers and their associated layers are preferred. Photopolymer, diazo, vesicular image-forming compositions and other systems may be used in addition to silver halide.

The film support for the emulsion layers used in the novel process may be any suitable transparent plastic or paper. Examples of suitable plastics include, but are not limited to, cellulosic supports, e.g. cellulose acetate, cellulose triacetate, cellulose mixed esters, polyethylene terephthalate/isophthalates and the like. The above polyester films are particularly suitable because of their dimensional stability. During the manufacture of the film it is preferable to apply a resin subbing layer such as, for example, the mixed-polymer subbing compositions of vinylidene chloride-itaconic acid, taught by Rawlins in U.S. Pat. No. 3,567,452, or antistatic compositions as taught by Miller U.S. Pat. Nos. 4,916,011 and 4,701,403 and Cho U.S. Pat. No. 4,891,308.

The coated element of a photographic film is dryed by liquid medium evaporation. The evaporation is preferably accelerated by conduction, convection and/or radiation heating. Heat transfer can occur through the support such as by physical contact with a heated drum or roller or by direct contact with a gaseous medium such as warm air. Jet impingement of the coated layers with a gaseous medium provides both a heat and mass transfer medium. Radiation to which the photographic element is relatively insensitive can be used to facilitate liquid medium evaporation, and microwave heating.

The following examples are illustrative and are not intended to limit the scope of the invention described herein.

EXAMPLES

Slide coatings of two simultaneous layers were applied at 250 cm/min using a differential pressure upon coating start of approximately 1500 dy/cm$^2$. The uppermost layer was a 9.5% gelatin-water solution (viscosity=20 cP) and was coated at a thickness of 13 micrometers. The lowermost layer was a 5.75% gelatin solution with 7.4% AgBr colloidal suspension (viscosity=7.4 cP) and was coated at a thickness of 50 micrometers. Several coater lip geometries were tested using a common slide coater configuration having the slide surface inclined approximately 23° from horizontal and positioned such that the coating lip and substrate surface form a coating gap of 0.25 mm at approximately 5° above the horizontal centerplane of the roll. Three lip geometries tested had 6.4 mm wide, 0.36 mm deep rectangular transverse breaks located starting at 1.3 mm, 2.5 mm and 3.8 mm, respectively, below the lip tip on a coater lip surface inclined at 48° from the substrate tangent. A fourth coater lip did not have a break but rather, an uninterrupted coater lip surface for at least 10 mm below the lip tip. In each case the liquid film flow beginning with coating start was observed through magnification as detailed in Valentini, et al, I&EC Research, 1991, 30, 453–461. Liquid film transient duration was determined from video recording three replicate coating starts wherein the transient time was defined as the elapsed time between the start of coating and the observation of cessation of liquid motion on the lip surface immediately below the lower meniscus of the bead.

| Example # | Break location below lip tip (mm) | Average liquid film duration (seconds) |
|---|---|---|
| 1. | 1.3 | 0.2 |
| 2. | 2.5 | 1.3 |
| 3. | 3.8 | 1.7 |
| 4. | none | 5.0 |

In the following examples, the conditions were identical to those above except that the lowermost layer was an 8.75% gelatin solution with 7.4% AgBr colloidal suspension (viscosity=17 cP).

| Example # | Break location below lip tip (mm) | Average liquid film duration (seconds) |
|---|---|---|
| 5. | 1.3 | 0.7 |
| 6. | 2.5 | 1.8 |
| 7. | 3.8 | 5.4 |
| 8. | none | 7.5 |

These examples show that the presence of a break considerably shortens the liquid transient duration and that distance from the lip tip to the break can be chosen to beneficially control the transient duration.

Utilization of a low energy surface is accomplished by filling the break of the lip described in the previous example with an appropriate polyfluoroethylene. The above mentioned coating solutions are used in a manner identical to that described above.

I claim:

1. A slide bead coating apparatus having a bead region wherein a flowing liquid layer or plurality of flowing liquid layers is continuously applied to a moving substrate, said coating apparatus comprising:

a means for defining a bead region wherein a flowing liquid layer or layers is continuously applied to a moving substrate;

a roller, and associated drive means, for conveying said substrate longitudinally through said bead region;

a means for continuously supplying said flowing liquid layer or layers to a slide surface of a coating head;

a coating lip tip at the terminus of said slide surface of said coating head and within said bead region; and a lip surface extending from the coating lip tip down into the bead region opposite the moving substrate;

wherein the coating apparatus further comprises:

a break and associated offset in the lip surface capable of isolating the bead region from a reservoir of liquid below said break; said break being located 0.5–5.0 mm below said coating lip tip and forming an angle with said lip surface of at least 15° in a direction away from said substrate, and the offset having an average depth at least 0.25 mm from the plane of the lip surface and being at least 0.5 mm long.

2. The apparatus of claim 1, wherein said break forms an angle with said lip surface is at least 25° in a direction away from said substrate.

3. The apparatus of claim 1, wherein said break is located 2.0 to 3.5 mm below said coating lip tip.

* * * * *